US008056157B2

(12) United States Patent
Huang et al.

(10) Patent No.: US 8,056,157 B2
(45) Date of Patent: Nov. 15, 2011

(54) LIGHTWEIGHT SHOWER TRAY

(75) Inventors: Jack Huang, Ann Arbor, MI (US); Scott Kapelanski, Howell, MI (US)

(73) Assignee: Masco Corporation, Taylor, MI (US)

( * ) Notice: Subject to any disclaimer, the term of this patent is extended or adjusted under 35 U.S.C. 154(b) by 1398 days.

(21) Appl. No.: 11/601,219

(22) Filed: Nov. 17, 2006

(65) Prior Publication Data

US 2007/0130685 A1 Jun. 14, 2007

Related U.S. Application Data

(60) Provisional application No. 60/749,236, filed on Dec. 9, 2005.

(51) Int. Cl.

| | |
|---|---|
| *A47K 3/22* | (2006.01) |
| *A47K 3/34* | (2006.01) |
| *A47K 3/36* | (2006.01) |

(52) U.S. Cl. ..... 4/613; 4/612

(58) Field of Classification Search ..... 4/612, 613; 525/209

See application file for complete search history.

(56) References Cited

U.S. PATENT DOCUMENTS

| | | | | |
|---|---|---|---|---|
| 4,938,825 | A | 7/1990 | Macdonald | |
| 5,580,621 | A | 12/1996 | Kuszaj et al. | |
| 5,959,038 | A * | 9/1999 | Furukawa et al. | 525/209 |

FOREIGN PATENT DOCUMENTS

| | | | |
|---|---|---|---|
| EP | 0 430 448 | | 6/1991 |
| EP | 1460186 | A1 * | 9/2004 |
| GB | 2093342 | A * | 9/1982 |
| GB | 2403143 | | 12/2004 |

OTHER PUBLICATIONS

International Search Report and Written Opinion dated Apr. 5, 2007.
International Preliminary Report on Patentability mailed on Jun. 19, 2008.

* cited by examiner

*Primary Examiner* — Tuan Nguyen
(74) *Attorney, Agent, or Firm* — Carlson, Gaskey & Olds, P.C.

(57) ABSTRACT

A shower stall tray includes a plastic shell defining an outer surface and a cavity that is filled with a light weight resinous material and a structural member having a density less than the resinous material. The plastic shell is formed to include a visible surface and a backside surface. The backside of the plastic shell defines an open cavity that is filled with a resinous material. The resinous material provides structural rigidity and the solid substantial feel providing a favorable perception of quality. The structural member not only provides structural support for the shower tray, but also displaces resinous material, thereby reducing the amount of resinous material required to fill the open cavity.

16 Claims, 4 Drawing Sheets

LIGHTWEIGHT SHOWER TRAY

CROSS REFERENCE TO RELATED APPLICATION

The application claims priority to U.S. Provisional Application No. 60/749,236 which was filed on Dec. 9, 2005.

BACKGROUND OF THE INVENTION

This invention generally relates to a shower tray for shower stalls. More particularly, this invention relates to a shower tray including features for reducing weight and a method of producing a lightweight shower tray.

A shower tray is utilized in shower stalls to provide the floor structure. A shower tray includes openings for drain devices and also provides the structural base for the shower stall.

A practiced convention for producing shower trays is by forming a sheet of thermoformable plastic material into a desired shape. The desired shape typically includes features for containing and directing water flow to drain openings. The resulting thermoplastic sheet forms a shell with a hollow backside. The thermoplastic shell does not provide the desired strength required for a shower stall application and therefore is filled with a settable mixture. The settable mixture adds substantial weight to the shower tray as well as a solid feel that is desirable to provide a pleasing perception of quality.

As appreciated, some conventional prior art shower trays utilize rib structures to provide the required strength. Disadvantageously, although such rib structures provide the required structural strength but convey a perception of reduced quality due to a hollow sound and feel.

Further, shower stalls are increasing in size and the variety of available shapes. The increased size and shape are accompanied by an undesirable increase in weight of the shower tray. The increase in weight adds cost and increases difficulties during handling and installation.

Accordingly, it is desirable to design and develop a shower tray and method of producing a shower tray that reduces weight while still conveying the desired look and feel.

SUMMARY OF THE DISCLOSED EMBODIMENT

An example shower stall tray includes a plastic shell defining an outer surface and a cavity that is filled with a light weight resinous material and a structural member having a density less than the resinous material.

An example shower tray includes a plastic sheet that is formed into a plastic shell of a desired shape. The plastic shell is formed to include a visible surface and a backside surface. The backside of the plastic shell defines an open cavity that is filled with a resinous material. The resinous material provides structural rigidity, the desired solid substantial feel and a favorable perception of quality.

The resinous material includes a resin, a catalyst and filler materials. The resinous material is the greatest weight to the shower tray. The open cavity defined by the plastic shell of this invention includes a structural member that is comprised of material having an overall density that is less than that of the resinous material. The structural member not only provides structural support for the shower tray, but also displaces resinous material, thereby reducing the amount of resinous material required to fill the open cavity.

Accordingly, an example shower tray includes a low-density resinous material combined with low-density structural members to reduce an overall weight while maintaining the desired look and feel perceived as an indication of overall quality.

The features of the present invention can be best understood from the following specifications and drawings, the following of which is a brief description.

DETAILED DESCRIPTION OF THE PREFERRED EMBODIMENT

Figure 1:
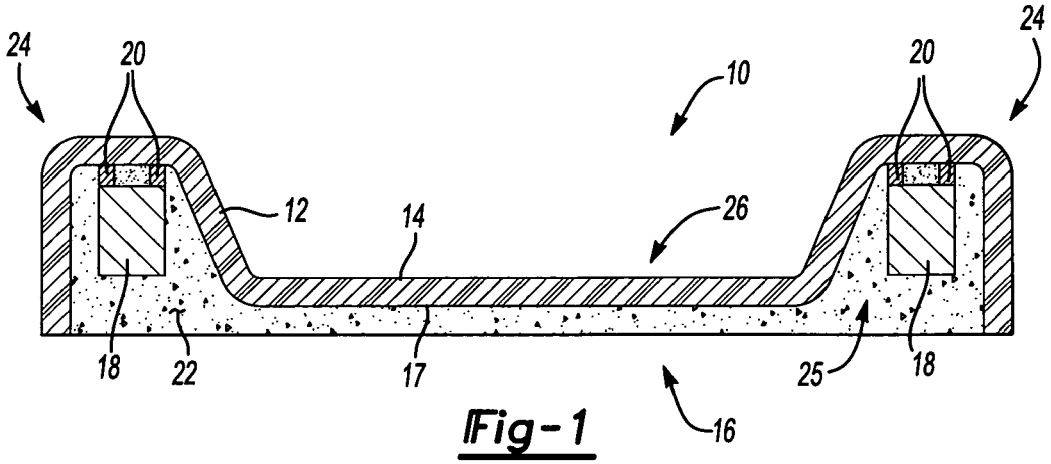
FIG. 1 is a schematic cross-section of an example shower tray according to this invention.
Figure 2:
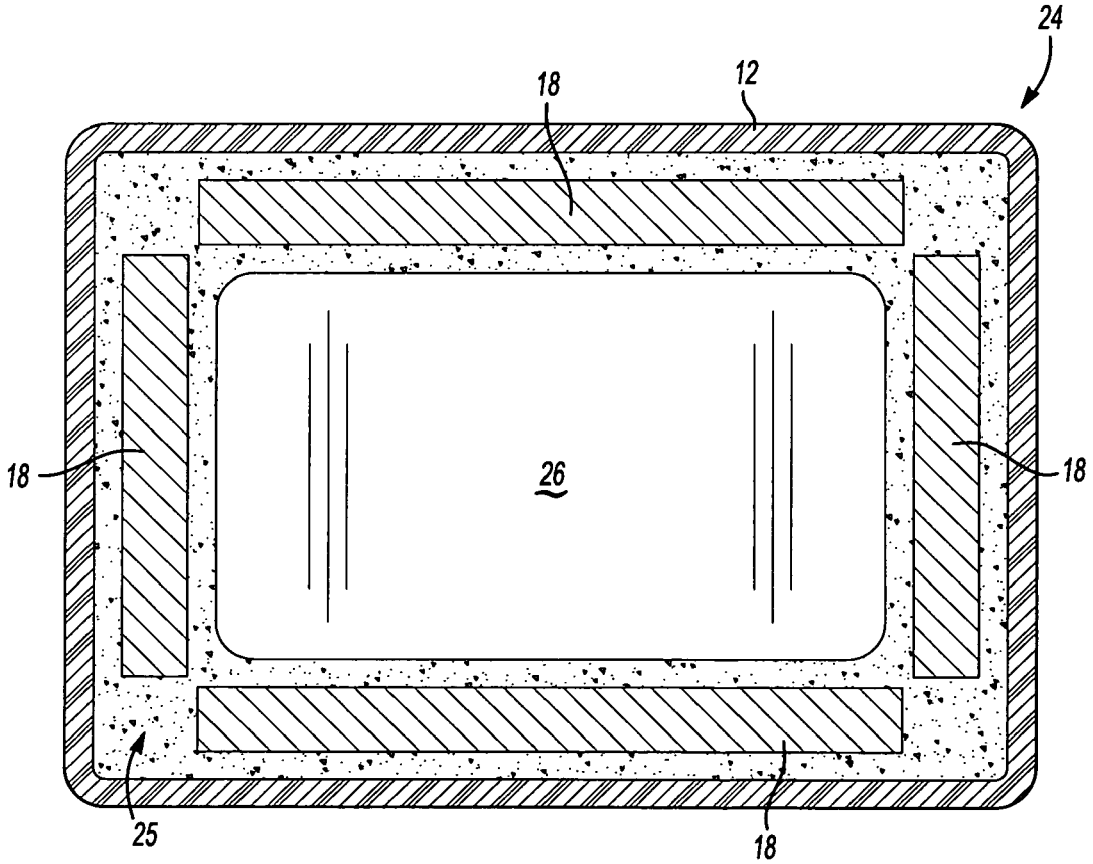
FIG. 2 is a schematic view of a bottom of an example tray according to this invention.

Referring to FIGS. 1 and 2, a shower tray 10 includes a plastic sheet that is formed into a plastic shell 12 of a desired shape. The plastic sheet is an acrylic thermoplastic that is formable into a desired shape through the application of heat as is known. The plastic shell 12 is formed to include a visible surface 14 and a bottom surface 17. The plastic shell 12 includes outer rim portions 24, a central pan portion 26, and a backside 16. The backside of the plastic shell 12 defines an open cavity 25 that is filled with a resinous material 22. The resinous material 22 provides structural rigidity and the solid substantial feel providing a favorable perception of quality.

The resinous material 22 includes a resin, a catalyst and filler materials. The resinous material 22 substantially provides the greatest amount of weight to the shower tray 10. As appreciated, as the size of the shower tray increases, so does the overall weight. The overall weight and solid appearance provided by entirely filling the plastic shell 12 provides the desired perception and solid feel pleasing to consumers. However, the increase in weight causes difficulties in handling, assembly and in shipping to the installation location.

The open cavity 25 defined by the plastic shell 12 of the example shower tray 10 includes a structural member 18 that is comprised of material having an overall density that is less than that of the resinous material 22. The structural member 18 not only provides structural support for the shower tray 10, but also displaces resinous material 22, thereby reducing the amount of resinous material required to fill the open cavity 25.

Referring to FIG. 2, the open cavity 25 of the example shower tray 10 is shown and includes several of the structural members 18 disposed in the deeper or thicker rim portions 24. The structural members 18 are of a material or composition that includes a density less than that of the resinous material 22 such that the denser resinous material 22 is displaced by the less dense structural member 18.

The structural members 18 are adhered to the backside surface 17 of the plastic sheet 12 to assure proper orientation during the filling process. The method of adhering need only hold the structural members 18 in place until the resinous material 22 solidifies. The structural members 18 can be directly attached to the plastic sheet 12 and may be spaced apart from the back surface 17 by spacers 20. The spacers 20 provide for the flow and disposition of resinous material 22 between the structural members 18 and the back surface 17.

Figure 3:
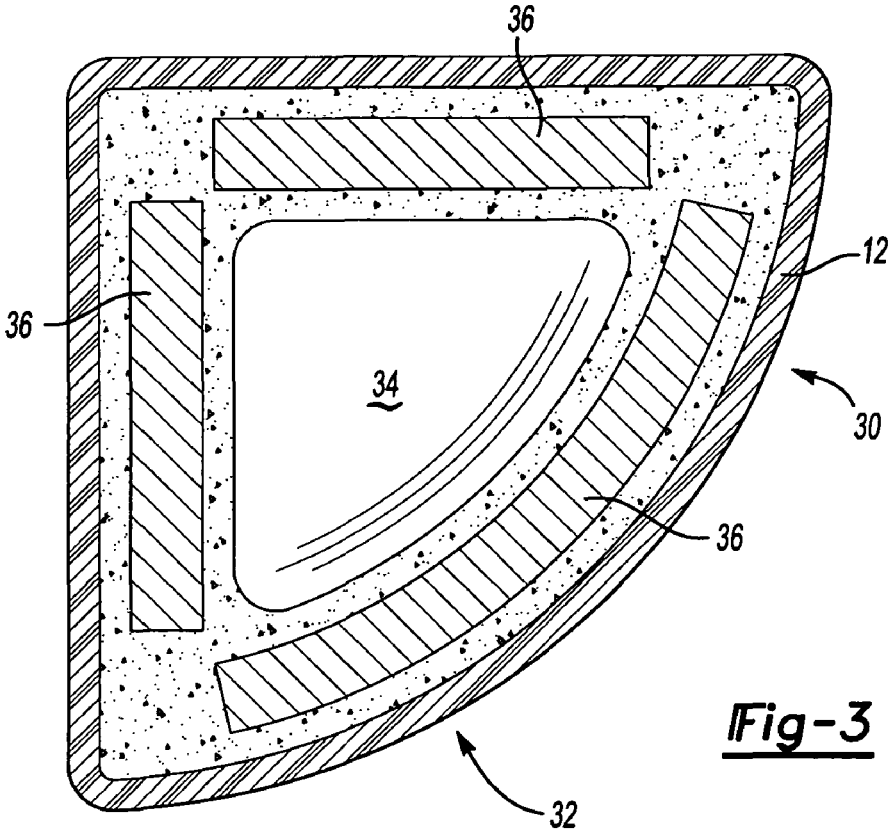
FIG. 3 is a schematic view of a bottom of another example tray according to this invention.
Figure 4:
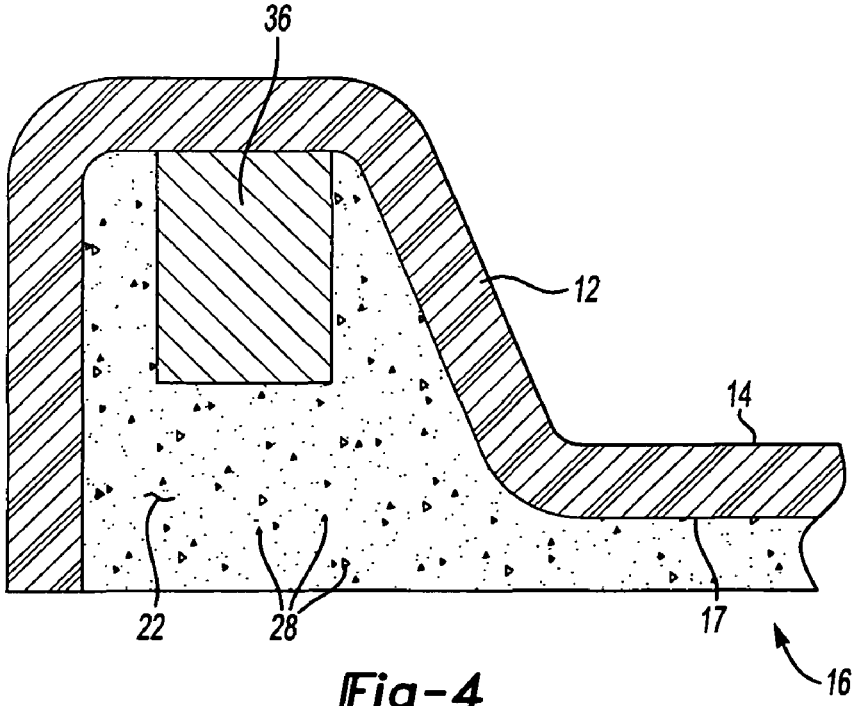
FIG. 4 is a cross-sectional view of a portion of an example shower tray.

Referring to FIGS. 3 and 4, another shower tray 30 comprises a substantially triangular shape. The shower tray 30 may be configured to provide any desired shape to fulfill desired application specific requirements. The shower tray 30 is formed with the plastic shell 12 to include rim portions 32 disposed about a periphery, and a centrally oriented pan portion 34. The rim portions 32 include structural members 36. The structural members 36 are fabricated from a material having a density less than that of the resinous material 22. The structural members 36 illustrated in FIG. 3 comprises a low-density rigid foam material that is placed within the rim portions 32 to both provide structural rigidity and displace a quantity of the resinous material.

The structural member 36 is completely covered with resinous material 22 once the plastic shell 12 is filled. In this way, the outward appearance of the shower tray 30 is consistent with the desired solid look and feel. However, the structural member 36 provides for a substantial reduction in weight.

The shower tray 30 also includes the further weight reduction feature of a low-density resinous material 22. The example resinous material 22 includes fillers comprising lighter materials to reduce the overall density of the resinous material 22.

Resinous material including common filler material would comprise a relatively high density. The resinous material 22 of the example shower tray 10 includes lighter weight filler materials such as lightweight clay aggregates, ceramic hollow spheres, and volcanic products such as pumice, perlite, and other known lightweight filler materials. These example filler materials are utilized individually or in any combination.

The reduced weight filler materials combine to reduce the density of the resinous material 22 to lower than that conventionally utilized. The combination of the reduced weight resinous material 22 and the displacement provided by the use of the low density structural materials for the structural members 18, 36 provide the significant desired weight reduction without sacrificing the strength, rigidity and solid feel indicative of a quality product. In the example configuration the low density structural members, along with the low-density resinous material provide approximately a 30-50% reduction in weight as compared to simply filling the entire cavity with conventional resinous mixture.

FIG. 4 illustrates an example structural member 36 comprised of low-density rigid foam. The example structural member 36 includes a substantially rectangular cross section. However, other cross-sectional shapes are also within the contemplation of this invention. The shape of the structural member 36 is provided to minimize cost, and maximize strength without sacrificing the strength of the shower tray 30. Further, a volume of the structural member 36 is determined to displace a desired amount of resinous material 22. The desired amount of displaced resinous material 22 is that amount for the applications that maintains the desired look, and feel indicative of quality while minimizing the amount of resinous material 22.

Figure 5:
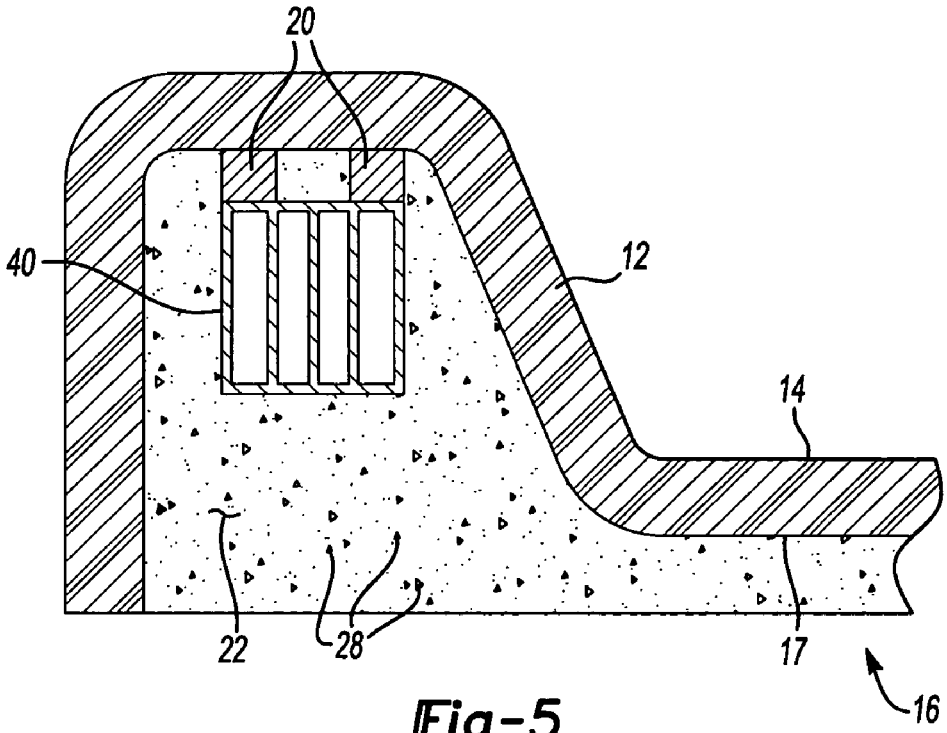
FIG. 5 is a cross-sectional view of a portion of another example shower tray.

Referring to FIG. 5, another example structural member 40 is illustrated and comprises a cardboard honeycomb matrix including a plurality of cells that are sealed off to prevent the resinous mixture from flowing therein. The structural member 40 provides a desired rigidity and displacement of resinous material 22 while consisting essentially of a plurality of air filled cells. The cross-sectional shape of the structural member 40 is illustrated as substantially rectangular. However, other shapes provided the desired rigidity and displacing the desired amount of resinous material 22 are also within the contemplation of this invention.

Figure 6:
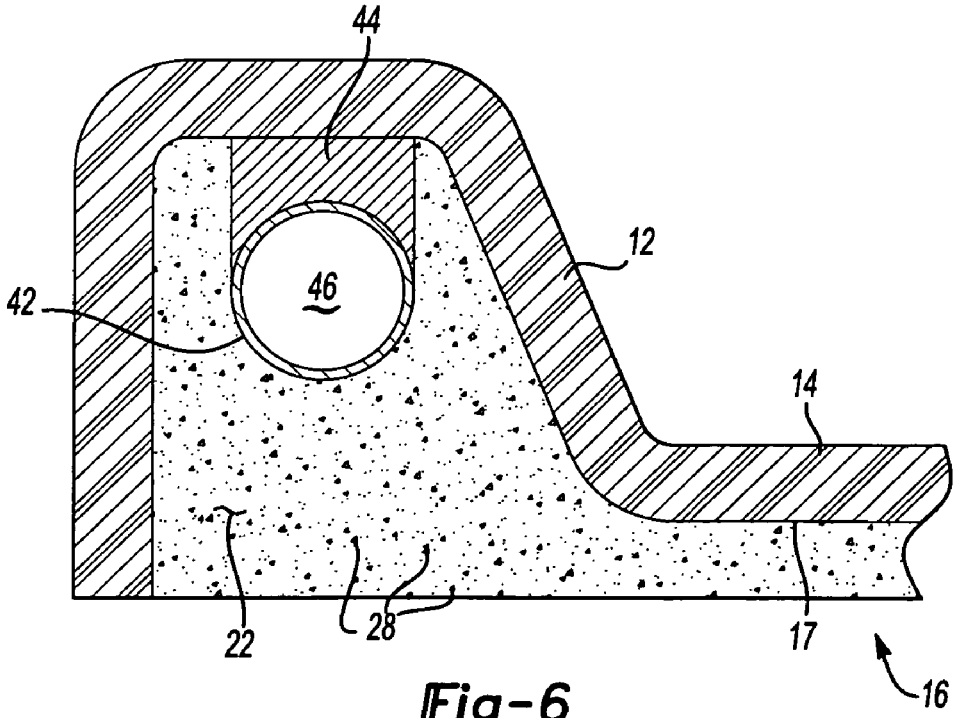
FIG. 6 is a cross-sectional view of another example shower tray.

Referring to FIG. 6, another example structural member 42 is illustrated and comprises a hollow member with closed ends that defines an empty space 46. The example structural member 42 is a tube and may be fabricated from cardboard, or from a common plastic material, such as polyvinylchloride (PVC), polystyrene, polyethylene terephthalate (PET) and others. The structural member 42 is mounted by a spacer 44 that is specifically suited to the outer shape of the tube. Although several examples of structural members are disclosed, other shapes and materials that provide a density lower than that of a comparable volume of resinous material 22 are also within the contemplation of this invention. Further, the size and shape can be modified to accommodate application specific requirements.

Figure 7:
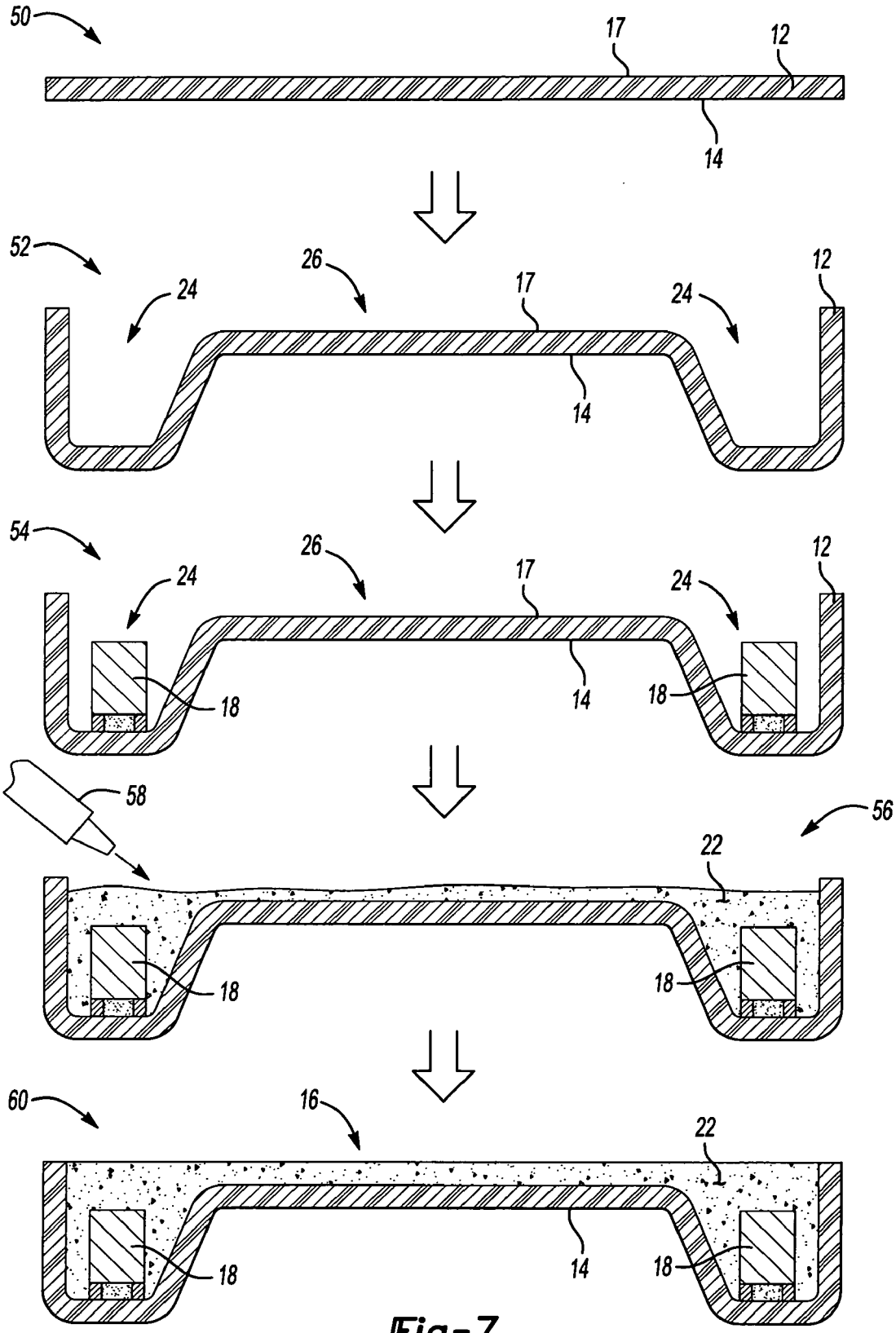
FIG. 7 is a schematic illustration of a process for fabricating a shower tray according to this invention.

Referring to FIG. 7, the example method of fabricating a shower tray 10 is schematically illustrated and begins with a flat sheet of thermoformable plastic 12 generally indicated at 50. The plastic sheet 12 is formed in a thermoforming process that allows the plate 12 to become pliable sufficiently to be pressed into the desired shape as is indicated at 52. Structural members 18 are then inserted and attached to the backside surface 17 within the rim portions 24. The structural members 18 are attached as indicated at 54 by an adhesive or other attachment method to maintain a desired orientation during filling of the resinous material 22. The resinous material 22 is dispensed from a source 58 to fill the shell formed by the plastic sheet 12 to a desired level that at least covers the structural members 18 as is indicated at 56. Once the resinous material cures, the plastic shell 12 is trimmed to provide a flat backside 16 and the plastic tray is complete as indicated at 60.

Accordingly, an example shower tray according to this includes a low-density resinous material combined with low-density structural members to reduce an overall weight while maintaining the desired look and feel of perceived as an indication of overall quality.

Although a preferred embodiment of this invention has been disclosed, this is not just a material specification and a worker of ordinary skill in this art would recognize that certain modifications would come within the scope of this invention. For that reason, the following claims should be studied to determine the true scope and content of this invention.

What is claimed is:

1. A shower tray assembly comprising:

a plastic shell defining an open cavity comprising a rim disposed about a periphery and a central pan portion;

at least one preformed structural member disposed within the plastic shell;

at least one spacer for holding the at least one structural member a distance apart from the plastic shell; and a resinous material filling the plastic shell, wherein said structural member comprises a material having a density lower than said resinous material.

2. The assembly as recited in claim 1, wherein said resinous material comprises a resin, a catalyst and filler material.

3. The assembly as recited in claim 2, wherein the filler material comprises at least one of a clay aggregate, ceramic hollow sphere, pumice, and perlite.

4. The assembly as recited in claim 1, wherein the preformed structural member comprises a low-density rigid foam.

5. The assembly as recited in claim 1, wherein the preformed structural member comprises a hollow member having a closed chamber.

6. The assembly as recited in claim 1, wherein the at least one spacer is fixed to the plastic shell and to the structural member for fixing a position of the preformed structural member relative to the plastic shell.

7. The assembly as recited in claim 1, wherein the plastic shell comprises a substantially rectangular shape.

8. The assembly as recited in claim 1, wherein the plastic shell comprises a substantially triangular shape.

9. A method of fabricated a shower tray assembly comprising the steps of:

a. thermoforming a plastic sheet into a shell including an open cavity comprising peripheral rim portions and a central pan portion;

b. forming a rigid structural member separate from the thermoformed shell;

b. mounting the at least one preformed rigid structural member within the open cavity; and c. filling the open cavity with a resinous material to a level at least covering the rigid structural member, wherein the at least one rigid structural member comprises a density lower than a density of the resinous material.

10. The method as recited in claim 9, wherein the resinous material comprises a resin, a catalyst and filler material.

11. The method as recited in claim 10, wherein the filler material comprises at least one of a clay aggregates, ceramic hollow spheres, pumice, and perlite.

12. The method as recited in claim 9, wherein said step b. comprises fixing the at least one rigid structural member a distance from the shell with at least one spacer.

13. The method as recited in claim 9, wherein the at least one rigid structural member comprises a low density foam.

14. The method as recited in claim 9, wherein the at least one rigid structural member comprise a hollow member having a closed chamber.

15. The method as recited in claim 9, wherein said step a. comprises forming a substantially rectangular shell.

16. The method as recited in claim 9, wherein said step a comprises forming a substantially triangular shell.

* * * * *